US005931263A

United States Patent [19]

Ericson et al.

[11] Patent Number: 5,931,263

[45] Date of Patent: Aug. 3, 1999

[54] QUASI-ELLIPTICAL BIDIRECTIONAL PROGRESSIVE SAFETY

[75] Inventors: Richard J. Ericson, Southington; Anthony Cooney, Unionville, both of Conn.

[73] Assignee: Otis Elevator Company, Farmington, Conn.

[21] Appl. No.: 08/816,904

[22] Filed: Mar. 13, 1997

[51] Int. Cl.[6] ..... B66B 5/04

[52] U.S. Cl. ..... 187/373; 187/359; 187/371; 188/72.7; 188/196 V; 188/196 BA; 188/184; 188/185; 188/72.3; 74/437; 74/422; 74/406

[58] Field of Search ..... 187/359, 371, 187/373; 188/184–7, 82.7, 82.74, 82.77, 72.3, 72.7, 72.8, 196 V, 196 BA; 74/437, 406, 110, 422

[56] References Cited

U.S. PATENT DOCUMENTS

| | | | |
|---|---|---|---|
| 1,459,650 | 6/1923 | Burnett | 74/437 X |
| 3,899,932 | 8/1975 | Durham | 74/437 X |
| 4,089,393 | 5/1978 | Falk | 188/72.7 X |
| 4,290,507 | 9/1981 | Brown | 188/72.7 X |
| 4,690,252 | 9/1987 | Kottke et al. | 74/813 X |
| 5,161,650 | 11/1992 | Taig | 188/72.8 |
| 5,547,048 | 8/1996 | Anthony | 188/72.7 X |

FOREIGN PATENT DOCUMENTS

| | | | |
|---|---|---|---|
| 004231560 | 3/1994 | Germany | 188/72.7 |
| 115201 | 5/1918 | United Kingdom | 188/72.7 |
| 270841 | 5/1927 | United Kingdom | 188/72.7 |

OTHER PUBLICATIONS

"Module 9.1 Carframes and Counterweights (High–Rise)," from Otis NAO Technical Training Manual, pp. 1–12.

A page from "For gears as unique as your needs," Winzeler, Inc.

A page from "Module 10.0" of Otis NAO Technical Training Handout Manual 1986, p. 13.

"Elevator Safety System" from a 1988 presentation delivered by Otis Elevator personnel, pp. 1–15.

"Module 9.0 Carframes and Counterweights" from Otis NAO Technical Training Handout Manual, pp. 1–16.

*Primary Examiner*—Johnny D. Cherry
*Assistant Examiner*—Steven B. McAllister

[57] ABSTRACT

An elevator safety based on having the elevator lift-rod, under the influence of the elevator governor, cause to rotate approximately elliptical cams, called quasi-elliptical cams. The cams are wider in one orientation, just as an ellipse has a major axis, wider than its minor axis. The cams are positioned to push against a brake pad as they rotate so that the major axis of each cam changes orientation with the minor axis. The cams can be shaped to simulate a wedge-type safety, even one using a wedge with multiple ramp angles. With essentially no additional complexity, the cam safety can be designed to operate with a bi-directional governor, one which exerts, usually through an intermediate linkage, force on the lift-rod in either the up or down motion depending on the unintended motion of the elevator.

17 Claims, 4 Drawing Sheets

FIG.4

| Vertical Travel $x_n$ of Brake Pad in Wedge Safety (mm) | Ramp Angle θ of Wedge (degrees) | Lateral Travel $y_n$ of Brake Pad in Wedge Safety (mm) | Angle of Rotation $\gamma_n$ of Elliptical Cam (degrees) | Radius $r_n$ of Elliptical Cam (mm) | Vertical Travel $s_n$ of Brake Pad in Cam Safety (mm) (One direction only) |
|---|---|---|---|---|---|
| 0.0 | 10 | 0.000 | 0.0 | 23.000 | 0.000 |
| 5.0 | 10 | 0.882 | 5.0 | 23.882 | 2.046 |
| 10.0 | 10 | 1.763 | 10.0 | 24.763 | 4.168 |
| 15.0 | 10 | 2.645 | 15.0 | 25.645 | 6.368 |
| 20.0 | 10 | 3.527 | 20.0 | 26.527 | 8.644 |
| 25.0 | 10 | 4.408 | 25.0 | 27.408 | 10.997 |
| 25.1 | 5 | 4.417 | 25.1 | 27.417 | 11.045 |
| 30.0 | 5 | 4.845 | 30.0 | 27.845 | 13.408 |
| 35.0 | 5 | 5.283 | 35.0 | 28.283 | 15.857 |
| 40.0 | 5 | 5.720 | 40.0 | 28.720 | 18.345 |
| 45.0 | 5 | 6.158 | 45.0 | 29.158 | 20.870 |
| 50.0 | 5 | 6.595 | 50.0 | 29.595 | 23.434 |
| 55.0 | 5 | 7.033 | 55.0 | 30.033 | 26.035 |
| 60.0 | 5 | 7.470 | 60.0 | 30.470 | 28.675 |
| 65.0 | 5 | 7.908 | 65.0 | 30.908 | 31.353 |
| 70.0 | 5 | 8.345 | 70.0 | 31.345 | 34.070 |
| 75.0 | 5 | 8.782 | 75.0 | 31.782 | 36.824 |
| 80.0 | 5 | 9.220 | 80.0 | 32.220 | 39.617 |
| 85.0 | 5 | 9.657 | 85.0 | 32.657 | 42.447 |
| 90.0 | 5 | 10.095 | 90.0 | 33.095 | 45.316 |

QUASI-ELLIPTICAL BIDIRECTIONAL PROGRESSIVE SAFETY

BACKGROUND OF THE INVENTION

1. Technical Field

The present invention pertains to elevators, and, more particularly, to the field of elevator safeties.

2. Description of the Related Art

Existing elevator safeties are wedge action devices, which work in only one direction. Such a safety cannot guard against unintended travel of an elevator cab in both the up and down direction. To guard against unintended motion in the up direction by an elevator using a wedge action safety, the conventional solution is to install a counterweight safety with its own wedge action safety, thus adding significant cost and complexity to the elevator design. Besides the counterweight safety approach, there are other solutions to the problem of unintended cab motion in the up direction, such as rope gripping devices, and Bode brakes. However, all existing solutions to the problem of guarding against unintended motion in the up direction require a system in addition to the system that safeguards the elevator against unintended down motion.

One reason an existing solution requires an add-on system, is that until recently, elevator governors have been unidirectional. The present invention is a response to the development of a bidirectional elevator governor, which suggests the possibility of a bidirectional safety, rather than two different safeties, one for unintended motion in each direction.

SUMMARY OF THE INVENTION

The present invention is a bidirectional safety intended to be used with a bidirectional governor to guard against unintended motion in both up and down directions. The safety of the present invention is based on the use of approximately elliptical cams, called here quasi-elliptical cams, which move a brake pad against the rail blade of the elevator system as the cams rotate in either of two directions, depending on whether the action being braked is in the up or down direction. The cams are caused to rotate by the bidirectional elevator governor through the influence of an intermediate linkage with the governor, this linkage known in the art and not part of the present invention.

The cams here are said to be "quasi-elliptical" to suggest their out-of-round, ellipse-like shape. As used throughout this specification, the term "quasi-elliptical" should be understood to mean that the cams are roundish so as to be rollable, and have a maximum and minimum diameter. The perimeter of such a cam does not necessarily obey the equation of an ellipse, although such a perimeter is intended to be within the scope of the term quasi-elliptical as used in this specification. In fact, as will be explained below, a cam in the preferred embodiment of a quasi-elliptical cam safety simulates a dual ramp angle wedge; the perimeter of such a cam is not actually elliptical.

In ordinary up and down motion, the cams are pushed to a position where they have a minimum radius relative to the direction of the elevator rail blade and brake pad. If the governor senses motion in either the up or down direction outside of an acceptable operating envelope, the governor will force (through an intermediate linkage) a lift-rod to move in one or the opposite direction, and so cause the cams to rotate through 90° in one or the opposite direction, moving the brake pad toward the rail blade as they are rotated. When the governor senses that the elevator motion has returned to within the operating envelope, it releases its force on the elevator lift-rod, and centering springs of the elevator safety restore the quasi-elliptical cams to their minimum radius neutral position, allowing the brake pad to pull-off the rail blade under the action of pull-off springs.

According to the present invention, a safety for an elevator system in a hoistway, where the elevator system has guide rails extending along opposite walls of the hoistway, a cab able to move along rail blades of the guiderails, a governor that can produce endwise force on a lift-rod attached to the cab, the safety attached to the cab and arranged to apply force on one of the two rail blades in order to slow unintended motion of the cab, comprises:

a safety block attached to a side of the cab facing said one of the rail blades, the safety block having two arms extending toward the rail blade and terminating approximately an equal distance from the rail blade, each arm having a slotted hole through which the lift-rod extends, the slotted hole allowing the lift-rod to move toward and away from the rail blade, the safety block further having a recessed void between the arms;

two quasi-elliptical cams arranged in the recessed void for rolling movement along a line parallel to the rail blade so that each rolls within the recessed void along that line between a rolling track surface on the safety block and a rolling track surface on the lift rod from a first maximum diameter position displacing the lift rod toward the rail blade through a minimum diameter position to a second maximum diameter position;

a length of brake pad anchored to the lift-rod at a neutral point between the arms of the safety block;

means for pulling the brake pad toward the quasi-elliptical cams away from the rail blade;

means for urging the brake pad to return to the neutral point when the brake pad is caused to move away from the neutral point by the governor producing endwise force on the lift-rod; and means for causing the quasi-elliptical cams to roll without slipping within the void when the governor exerts force on the lift-rod;

wherein the quasi-elliptical cams are oriented and positioned in the recessed void so that when the brake pad is at its neutral point the quasi-elliptical cams position the brake pad at maximum separation from the rail blade, and when the governor exerts force on the lift-rod, the quasi-elliptical cams rotate and move the brake pad into tractive engagement with the rail blade.

In further accord with the present invention, the safety also includes a means for urging, with a maximum predetermined force, the quasi-elliptical cams away from the safety block, toward the brake pad.

BRIEF DESCRIPTION OF THE DRAWINGS

The above and other features and advantages of the invention will become apparent from the consideration of the subsequent detailed description presented in connection with accompanying drawings, in which:

FIG. 4 is a table showing a calculation illustrating how the radius of each quasi-alliptical cam should be determined to simulate a conventional safety using a wedge with two ramp angles, a first ramp angle at 10° and a second at 5°.

DESCRIPTION OF THE PREFERRED EMBODIMENT

Figure 1:
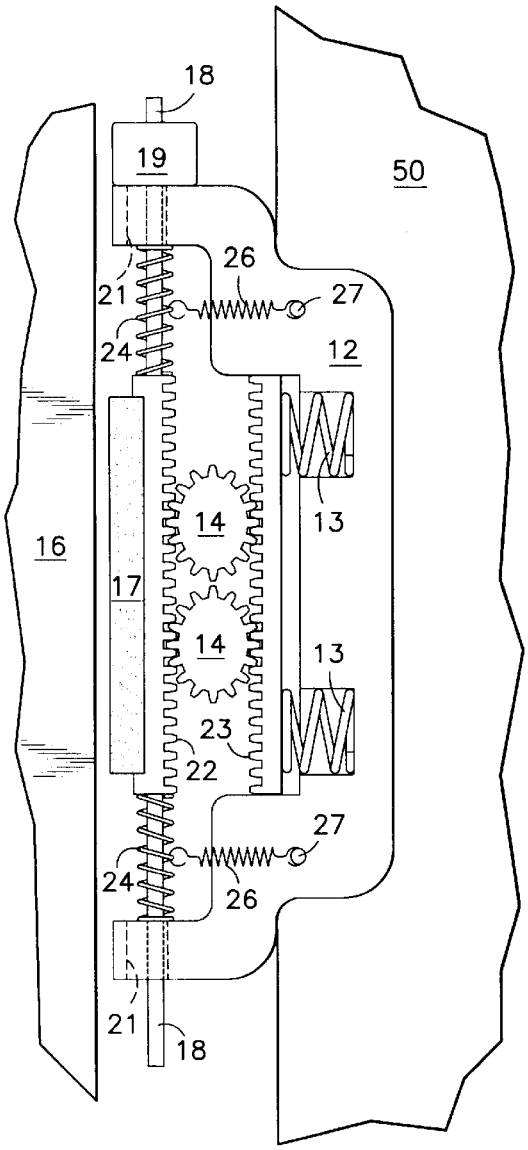
FIG. 1 is a side view of a quasi-elliptical cam bidirectional progressive safety, according to the present invention, disengaged.
Figure 1A:
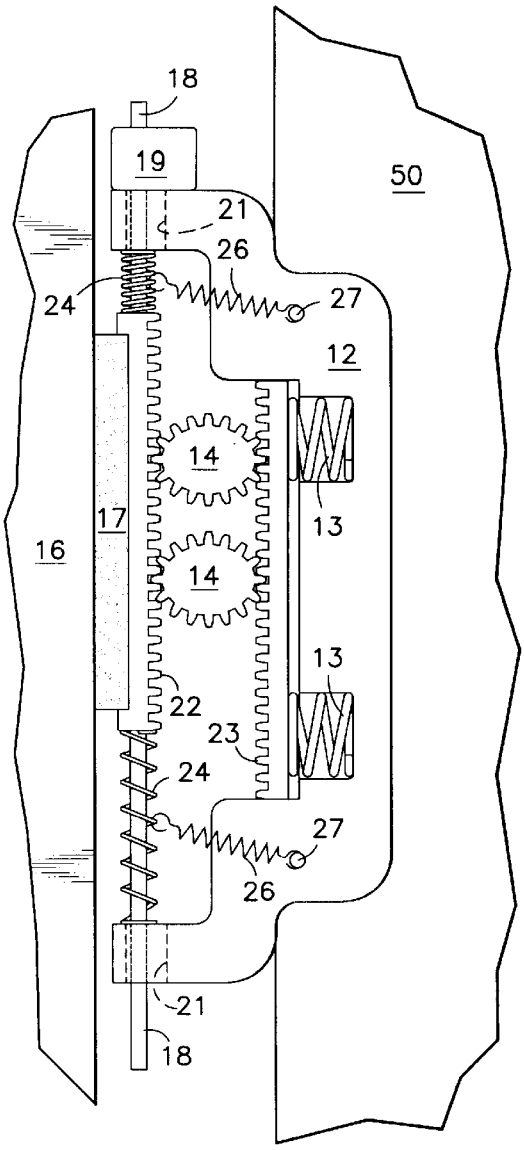
FIG. 1*a* is a side view of a quasi-elliptical cam bidirectional progressive safety according to the present invention, engaged.

Referring now to FIG. 1 and FIG. 1*a*, a quasi-elliptical cam bidirectional progressive safety according to the present invention comprises at least two quasi-elliptical cams 14, which push against block teeth 23 on the cab side 50, and brake pad teeth 22 on the side of the rail blade 16. In the preferred embodiment, both the block teeth 23 and brake pad teeth 22 are rack teeth. The block teeth are held off a safety block 12 by main springs 13. The brake pad teeth are anchored to the lift-rod 18 and are urged to a neutral position (the position shown in FIG. 1) by centering springs 24. The safety block 12 is attached to the elevator cab (not shown).

The brake pad teeth 22 hold a brake pad 17 on a rail blade 16 when braking the elevator cab, but not when the elevator cab motion is within a pre-determined operating envelope. The brake pad is caused to move onto the rail blade 16 under the action of the lift-rod 18, which is moved in either vertical direction (up or down) relative to the elevator cab (and the safety block), causing the quasi-elliptical cams 14 to rotate through 90° and to move linearly in the same direction as the lift-rod. FIG. 1*a* shows the safety engaged. In the preferred embodiment, the quasi-elliptical cams 14 have gear teeth that match the rack teeth of the block teeth 23 and brake pad teeth 22.

Normally, but not necessarily, there will be a safety for each guide rail, the two safeties deployed on opposing sides of the cab with respect to opposing hoistway guide rails, and beneath the elevator cab.

The safety block 12 can be a cast or, more reliably, forged steel. In addition, there are other materials that can be used to make the safety block that would be obvious to one skilled in the art. The particular material used for the safety block is not a limitation of the present invention.

Because the quasi-elliptical cams 14 are approximately elliptical, the separation between the brake pad teeth 22 and block teeth 23 changes as the quasi-elliptical cams rotate. In the position shown in FIG. 1, the quasi-elliptical cams 14 hold the brake pad teeth 22 and block teeth 23 at minimum separation, and so the brake pad 17 is held away from the rail blade 16 by the pull-off springs 26 attached to the safety block 12 by spring pegs 27. When the bidirectional governor senses elevator cab motion outside of the operating envelope, it will exert a force resulting in lift-rod 18 being pushed or pulled, causing the quasi-elliptical cams 14 to rotate through 90° while moving in either the up or down direction. The rotation of the quasi-elliptical cams 14 will move the brake pad teeth 22 to maximum separation from the block teeth 23, and force the brake pad 17 onto the rail blade 16 with a force that depends on the angle through which the quasi-alliptical cams have been rotated.

The pull-off springs 26 are just one example of how to pull the brake pad 17 off the rail blade 16 when the elevator motion returns to acceptable limits, and the centering springs 24 return the brake pad teeth 22 to the neutral position, which is, in this preferred embodiment, a center position. There is little force to overcome in pulling the brake pad off the rail blade after the centering springs restore the brake pad to the neutral position, and various means of retracting the brake pad may be employed, such as, for example, the use of a magnetic field produced by a magnet located on either the safety block, the brake pad teeth.

At 90° rotation, the quasi-elliptical cams hold the brake pad teeth 22 and block teeth 23 at maximum separation, forcing the brake pad 17 onto the rail blade 16 with maximum force. The brake pad 17, attached to the brake pad teeth 22, which are in turn attached to the lift-rod 18, is able to move away from the safety block 12 and onto the rail blade 16 because the lift-rod 18 is inserted through slotted holes 21 in the arms of the safety block 12. Both ends of the approximately U-shaped safety block 12 have slots 21 in which the lift-rod 18 can move relative to the elevator cab (not shown) and brake pad 17.

Figure 2:
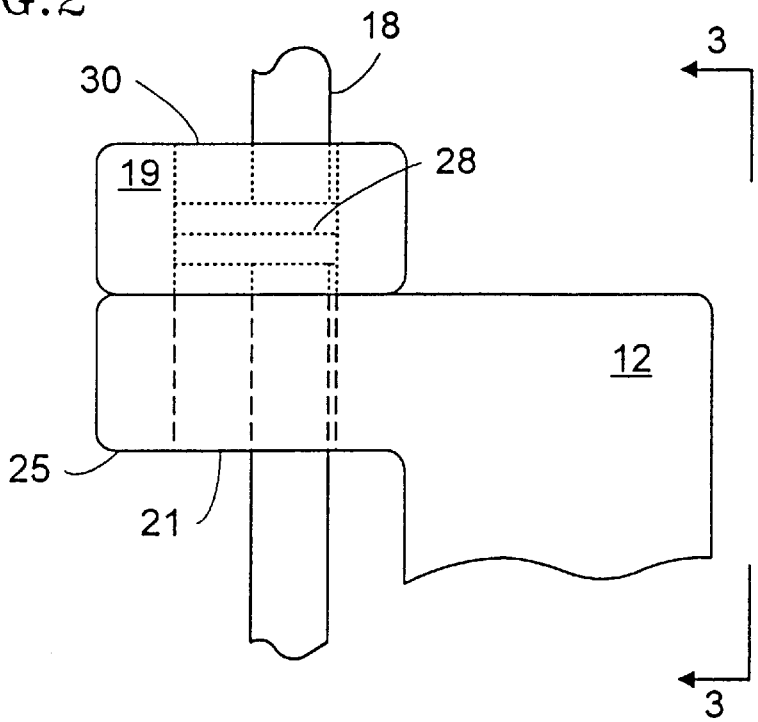
FIG. 2 is a side view of a spring detent releasing carrier as used in the present invention.
Figure 3:
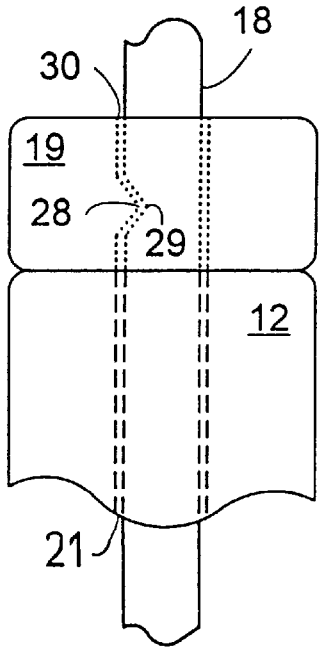
FIG. 3 is also a view of a spring detent releasing carrier, but seen from behind the cast safety block looking toward the rail blade of the elevator system.

In addition, at one end of the safety block, just as in existing elevator systems in high-rise structures, there is a spring detent releasing carrier 19 (the same kind as is used in existing elevator systems), which is also slotted as shown in FIGS. 2 and 3. This assembly is needed only in high-rise elevator systems. It is used to compensate for the inertia of the line attaching the safety to the governor at the top of the hoistway.

The slots 21 extend in only one direction, in the plane of the figure, from the safety block 12 to the rail blade 16, i.e., perpendicular to the hoistway wall. FIG. 2 shows the spring detent releasing carrier 19 from the same perspective as shown in FIG. 1. The slot 21 in the safety block 12 leads to a slot 30 in the spring detent releasing carrier 19. FIG. 3 is a view of the same elements looking toward the rail blade 16 from the safety block 12. In FIG. 3, the spring detent releasing carrier is shown to have the slot 30 which, when viewed from the perspective of FIG. 3, includes a dimple 28 that mates with an indention 29 in the lift-rod 18 when the lift-rod is in its neutral position (when the elevator cab is moving within its operating envelope).

In another embodiment of the present invention, the function of the spring detent releasing carrier 19 is accomplished without a separate structure 19, by creating the detent dimple in one of the slots 21.

When the bidirectional governor actuates the safety through the lift-rod 18 so that the brake pad 17 is forced onto the rail blade 16, the main springs 13 help keep the force that urges the brake pad 17 onto the rail blade 16 within tolerable limits and approximately constant for a given rotation of the quasi-elliptical cams 14, even though the elevator cab may be moving rapidly toward or away from the brake pad 17 for any of a number of reasons, such as vibration of the elevator cab as it moves along its guide rails.

When the governor removes all force from the lift-rod 18, centering springs 24 move the brake pad 17 back toward the center of the approximately U-shaped safety block 12 causing the quasi-elliptical cams 14 to rotate back to the position shown in FIG. 1, where they hold the brake pad teeth 22 at minimum separation from the block teeth 23.

Figure 5:
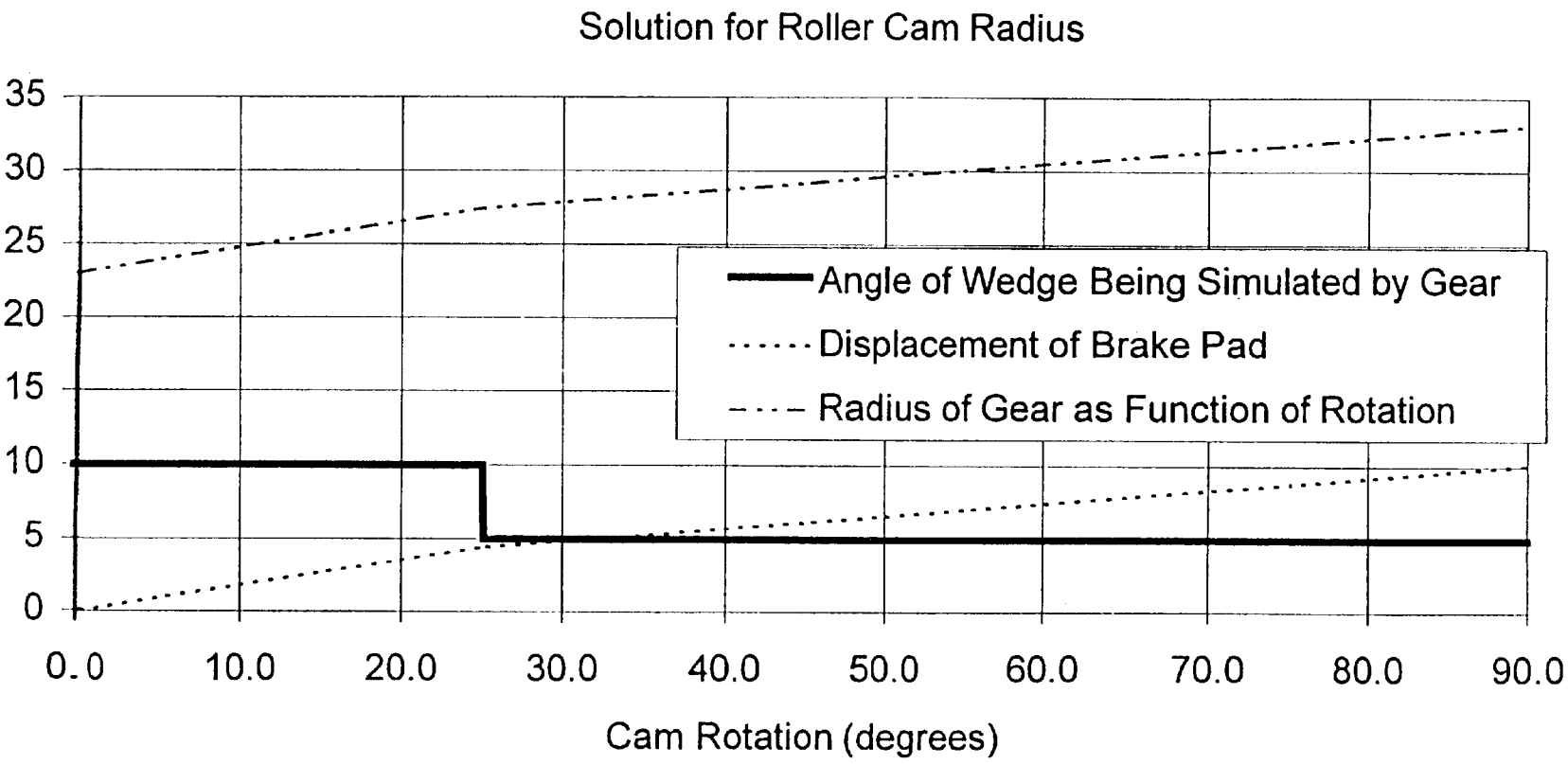
FIG. 5 is a graphic output of the calculation presented in FIG. 4.

FIGS. 4 and 5 illustrate how to shape a cam to approximately reproduce the effect of having a wedge-type safety with two different values of ramp angle Q. The first two columns of the table shown in FIG. 4 describe the dual ramp angle wedge that is to be simulated using the quasi-elliptical cam safety of the present invention.

In a conventional wedge-type safety, when the governor exerts force on a safety's lift-rod, a brake pad is pulled over the face of a wedge so that as it moves vertically it also moves laterally toward the rail blade. The larger the ramp angle the greater the movement toward the rail blade for each unit distance traveled vertically. The first two columns of FIG. 4 describe a wedge that begins with a ramp angle of 10° and continues for a vertical distance of $x_n$ equal to 25.0 mm. The ramp angle q then changes to 5° and continues for vertical displacement $X_n$ up to 90 mm.

The third column shows the lateral displacement $y_n$ of the brake pad of the wedge safety for the vertical displacement of $x_n$ in column 1, according to $$y_n=Q(25-X_n)X_n \tan(q)+Q(X_n-25)[(X_n-25)\tan(q)+25 \tan(10°)],$$

where Q(x) is the step function, which is of value one when the argument x is non-negative, and zero otherwise.

In the fourth column of FIG. 4, the angle of rotation $g_n$ of a quasi-elliptical cam is arbitrarily asserted to match, numerically, the vertical displacement $x_n$ of the wedge safety in FIG. 1. Had column 1 ranged between numbers other than 0 and 90, the rotation angle $g_n$ would still range from 0 to 90 degrees but the mapping onto the range of the first column would be different.

The fifth column of FIG. 1 shows the radius $r_n=R+y_n$ of a quasi-elliptical cam at the angle $g_n$ of the preceding column, for a quasi-elliptical cam with minimum radius R=23.0 mm. When the quasi-elliptical cam rotates through the angle of the preceding column its radius increases from the minimum radius R by the amount of lateral displacement $y_n$ shown in column 3. Note that this is an increase in the radius $r_n$ of the quasi-elliptical cam, not the diameter. Thus the diameter increases by twice the amount shown in column 3 as the quasi-elliptical cam rotates to the angle $g_n$ shown in column 4. Half of this increase in diameter is taken up by the distance between the block teeth 23 and the safety block 12 shown in FIG. 1. The other half is taken up between the brake pad 17 and the rail blade 16, also shown in FIG. 1.

The last column of FIG. 4 shows the vertical distance $S_n$ traveled by the brake pad 17 relative to the safety block 12 (of FIG. 1), according to $$S_n=S_{n-1}+(r_n+r_{n-1})(g_n-g_{n-1})/2$$

and so is a measure of the size of the safety block needed for the safety using quasi-alliptical cams, with a minimum radius of 23.0 mm simulating a bilinear wedge-type safety described by the first two columns of FIG. 4.

FIG. 5 is a graphic representation of the results of the calculation presented in the 20 table of FIG. 4. It shows the second, third and fifth column of the table of FIG. 4 plotted against the angle of rotation of the quasi-elliptical cam shown in the fourth column of FIG. 4. The dash-dot-dot curve of FIG. 5 is the sought-after solution of how to shape the cam to simulate the effect of having a dual ramp angle wedge safety described by the first two columns of FIG. 4.

In practice, it is found, for different reasons, that it is usually not possible to have a wedge ramp angle of more than 5°. Therefore, existing wedge type safeties have a length significantly longer (about twice as much) as the length indicated by the vertical travel shown in the first column of FIG. 4 (for a wedge angle that starts at 10°).

Consequently, since the quasi-elliptical cam safety is able to simulate the dual ramp angle wedge-type safety, and do so in a length of about one-half the distance needed for the wedge safety for each vertical direction (up and down), the full length of the quasi-alliptical cam safety will be about twice what is shown in the last column of FIG. 4, and therefore will correspond to the length of the dual ramp angle wedge safety, which amounts to about one-half the length of a wedge safety able to be realized in practice.

The compressive force of the main springs 13 (FIG. 1) should be based on the braking material selected. Using cast iron as a braking material, the compressive force can be the same as in current designs. To provide the appropriate compressive force for a cast iron brake pad, in place of helical or C-type springs, which are becoming more expensive, belleville springs can be used.

Some recently developed brake materials may require compressive forces that differ significantly from what is required with a cast iron brake. Wedge safeties cannot use brake materials that require significantly lower compressive forces, because the height of the safety must be approximately twice the length of the wedge. Therefore, when using a braking material that cannot withstand higher compressive forces, more must be used, making the wedge longer, and therefore sometimes too high to fit between the elevator cab and the rail blade of the elevator system. The overall length of the cam safety, by comparison, need not be twice its length; in fact it may be just slightly more than the brake pad length. Therefore, a cam safety can use a low pressure brake pad material impossible to use in a wedge safety.

It is to be understood that the above described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. A safety for an elevator system in a hoistway, where the elevator system has guide rails extending along opposite walls of the hoistway, a cab able to move along rail blades of the guiderails, a governor that can produce endwise force on a lift-rod attached to the cab, the safety attached to the cab and arranged to apply force on one of the two rail blades in order to slow unintended motion of the cab, the safety comprising:

a safety block attached to a side of the cab facing said one of the rail blades, the safety block having two arms extending toward the rail blade and terminating approximately an equal distance from the rail blade, each arm having a slotted hole through which the lift-rod extends, the slotted hole allowing the lift-rod to move toward and away from the rail blade, the safety block further having a recessed void between the arms;

two quasi-elliptical cams arranged in the recessed void for rolling movement along a line parallel to the rail blade so that each rolls within the recessed void along that line between a rolling track surface on the safety block and a rolling track surface on the lift rod from a first maximum diameter position displacing the lift rod toward the rail blade through a minimum diameter position to a second maximum diameter position;

a length of brake pad anchored to the lift-rod at a neutral point between the arms of the safety block;

means for pulling the brake pad toward the quasi-elliptical cams away from the rail blade;

means for urging the brake pad to return to the neutral point when the brake pad is caused to move away from the neutral point by the governor producing endwise force on the lift-rod; and means for causing the quasi-elliptical cams to roll without slipping within the void when the governor exerts force on the lift-rod;

wherein the quasi-elliptical cams are oriented and positioned in the recessed void so that when the brake pad is at its neutral point the quasi-elliptical cams position the brake pad at maximum separation from the rail blade, and when the governor exerts force on the lift-rod, the quasi-elliptical cams rotate and move the brake pad into tractive engagement with the rail blade.

2. A safety as claimed in claim 1, further comprising means for urging, with a maximum predetermined force, the quasi-elliptical cams away from the safety block, toward the brake pad.

3. A safety as claimed in claim 2, wherein a slotted hole of the safety block is dimpled along a wide diameter of the slot, and the lift-rod is indented so as to receive the dimple in the slotted hole when the brake pad is at its neutral position.

4. A safety as claimed in claim 2, further comprising an attachment to the safety block, the attachment positioned on an arm of the safety block away from the recessed void, the attachment having a slotted hole that matches the slotted hole in the arm of the safety block to which it is attached, the attachment having a dimple extending along the wide diameter of its slotted hole, the lift-rod indented so as to receive the dimple in the slotted hole of the attachment when the brake pad is at its neutral position.

5. A safety as claimed in claim 2, wherein the means for causing the quasi-elliptical cams to roll within the recessed void when the governor exerts force on the lift-rod are provided by attaching a first length of rack teeth along the lift-rod adjacent to the two quasi-elliptical cams, providing matching gear teeth on the cams, and providing a second length of rack teeth matching the first length of rack teeth and the cam teeth, and arranged parallel to the first length of rack teeth, but positioned on the other side of the cams, thereby preventing the cams from slipping and assuring their rolling movement when the lift-rod moves.

6. A safety as claimed in claim 2, wherein the means for urging with a maximum predetermined force the cams away from the safety block include a resiliently deformable structure pushing against the safety block on one side and pushing against the second length of rack teeth on the opposite side.

7. A safety as claimed in claim 6, wherein the resiliently deformable structure includes an element selected from the set consisting of belleville spring, helical spring, and C-type spring.

8. A safety as claimed in claim 2, wherein the means for urging the brake pad back to the neutral point includes two compressed helical springs, each inserted encircling the lift-rod, compressed between the brake pad on one side and an arm of the safety block on the other side, whereby the brake pad is held at the neutral point in the absence of a force on the lift-rod produced by the governor.

9. A safety as claimed in claim 2, wherein the means for pulling at one end the brake pad toward the quasi-elliptical cams includes two helical tension springs, each having a first end slidably attached to the lift-rod at one end of the brake pad, and attached, at its opposite, second end, to the safety block.

10. A safety for an elevator system in a hoistway, where the elevator system has guide rails extending along opposite walls of the hoistway, a cab able to move along rail blades of the guiderails, a governor that can exert force on a lift-rod attached to the cab, the safety attached to the cab and arranged to apply force on one of the two rail blades in order to slow unintended motion of the cab, the safety comprising:

two quasi-elliptical cams arranged so that each is rotatably mounted along a line parallel to said one of the rail blades and can be rolled along that line;

a length of brake pad anchored to the lift-rod;

means for causing the quasi-elliptical cams to roll without slipping when the governor exerts force on the lift-rod;

wherein the quasi-elliptical cams are oriented and positioned, with respect to the length of brake pad and the means for causing the quasi-elliptical cams to roll without slipping, so that when the governor exerts force on the lift-rod, the quasi-alliptical cams roll without slipping and move the brake pad onto the rail blade, and when the governor removes force from the lift-rod, the quasi-elliptical cams are free to roll without slipping and move the brake pad away from the rail blade.

11. A safety for an elevator system having a cab movable in a multi-story hoistway with a guide rail positioned beside the cab in the hoistway, and with a governor connected to produce endwise force on a safety lift rod having a brake pad anchored thereon, said lift rod being mounted on the cab near the guide rail, the safety comprising:

a safety block mounted on the cab and positioned to guide the lift rod for lateral movement of the brake pad toward and away from the guide rail;

at least two quasi-elliptical cams, each having a major diameter and a minor diameter, each mounted for rolling movement along a line substantially parallel to the guide rail; and a pair of cam tracks resiliently biased toward each other and tractively embracing the quasi-elliptical cams for rolling movement between said tracks, a first said cam track being mounted on said safety block and a second said cam track being mounted on the lift rod;

said governor being connected to position the lift rod in a neutral position in which said cam tracks are spaced apart by the minimum diameter of the quasi-elliptical cams during normal elevator operation, and to move the lift rod endwise to an actuated position in which the relative movement of the cam tracks rolls the quasi-alliptical cams to space the cam tracks apart by the cams' major diameter, tractively engaging the brake pad with the guide rail to retard undesired movement of the cab in the hoistway.

12. A safety as claimed in claim 11, wherein the safety block has two arms extending toward the guide rail and terminating approximately an equal distance from the guide rail, each arm having a slotted hole through which the lift-rod extends, the slotted hole allowing the lift-rod to move toward and away from the guide rail, the safety block further having a recessed void between the arms, the safety further comprising an attachment to the safety block, the attachment positioned on an arm of the safety block away from the recessed void, the attachment having a slotted hole that matches the slotted hole in the arm of the safety block to which it is attached, the attachment having a dimple extending along the wide diameter of its slotted hole, the lift-rod indented so as to receive the dimple in the slotted hole of the attachment when the brake pad is at its neutral position.

13. A safety as claimed in claim 12, wherein a slotted hole of the safety block is dimpled along a wide diameter of the slot, and the lift-rod is indented so as to receive the dimple in the slotted hole when the brake pad is at its neutral position.

14. A safety as claimed in claim 12, further comprising two compressed helical springs, each inserted encircling the lift-rod, compressed between the brake pad on one side and an arm of the safety block on the other side, for urging the brake pad back to the neutral point in the absence of a force on the lift-rod produced by the governor.

15. A safety as claimed in claim 12, further comprising two helical tension springs, each having a first end slidably attached to the lift-rod at one end of the brake pad, and attached, at its opposite, second end, to the safety block, for pulling at one end the brake pad toward the quasi-elliptical cams.

16. A safety as claimed in claim 11, wherein the resilient biasing of the cam tracks toward each other comprises a resiliently deformable structure pushing against the safety block on one side and pushing against one of the pair of cam tracks on the opposite side, for urging with a maximum predetermined force the cams away from the safety block.

17. A safety as claimed in claim 16, wherein the resiliently deformable structure includes an element selected from the set consisting of belleville spring, helical spring, and C-type spring.

* * * * *